US007434568B1

(12) United States Patent
Gachik et al.

(10) Patent No.: US 7,434,568 B1
(45) Date of Patent: Oct. 14, 2008

(54) METHOD AND APPARATUS FOR LIQUID FUEL CONDITIONING TO IMPROVE COMBUSTION

(75) Inventors: Igor A. Gachik, Boca Raton, FL (US); Lev M. Gurarye, Sunny Isles Beach, FL (US); Victor N. Gurin, Hollywood, FL (US); Yuri S. Levin, Weston, FL (US); Roman J. Press, Pitsford, NY (US); Naum Staroselsky, Sunny Isles Beach, FL (US); Semen Vaynblat, Coral Springs, FL (US)

(73) Assignee: Ultimate Combustion CorporationFL (US)

( * ) Notice: Subject to any disclaimer, the term of this patent is extended or adjusted under 35 U.S.C. 154(b) by 0 days.

(21) Appl. No.: 11/824,977

(22) Filed: Jul. 3, 2007

(51) Int. Cl.
*F02B 43/00* (2006.01)

(52) U.S. Cl. ..... 123/527; 123/1 A

(58) Field of Classification Search ..... 123/1 A, 123/527

See application file for complete search history.

(56) References Cited

U.S. PATENT DOCUMENTS

| | | | | |
|---|---|---|---|---|
| 4,376,423 | A * | 3/1983 | Knapstein | 123/1 A |
| 4,596,210 | A | 6/1986 | Schmidtke | |
| 6,273,072 | B1 | 8/2001 | Knapstein et al. | |
| 7,011,048 | B2 | 3/2006 | Gurin et al. | |

FOREIGN PATENT DOCUMENTS

| | | | |
|---|---|---|---|
| JP | 60169660 | A * | 9/1985 |

* cited by examiner

*Primary Examiner*—Noah Kamen
(74) *Attorney, Agent, or Firm*—Laurence A. Greenberg; Werner H. Stemer; Ralph E. Locher

(57) ABSTRACT

A fuel is conditioned in a fuel supply system for more efficient combustion in a combustion chamber. The conditioning system includes a plurality of vessels, each defining a fuel chamber for fuel conditioning, at least one fuel dispersing nozzle mounted for discharge into the fuel chamber, at least one gas inlet port, a gas outlet port with a gate valve and a pressure reducer mounted thereon. A low level sensor registers a low level of conditioned fuel in the fuel chamber. A gas source feeds a gas to the vessels wherein the gas is dissolved in the liquid fuel for forming a liquid/gas fuel solution. A gas delivery and gas pressure control system with flow-directional valves and gas pressure regulators supply gas and maintain a relatively high, first gas pressure $P_1$ and a relatively low, second gas pressure $P_2$. A low-pressure fuel pump and a liquid fuel supply line supply liquid fuel from a fuel reservoir to the at least one dispersing nozzle of each fuel chamber at a third pressure $P_3$ higher than the first pressure $P_1$. A high-pressure fuel pump feed the conditioned fuel to a combustion chamber at a fourth pressure $P_4$ that is higher than a pressure in the combustion chamber at a moment of combustion. Finally, there is provided an electronic control system connected to receive a signal from the low level sensor and for switching the gas delivery and gas pressure control system over from the fuel chamber indicated by the sensor as depleted to supply the conditioned fuel from another, filled-up fuel chamber.

9 Claims, 2 Drawing Sheets

METHOD AND APPARATUS FOR LIQUID FUEL CONDITIONING TO IMPROVE COMBUSTION

BACKGROUND OF THE INVENTION

Field of the Invention

The present invention relates to the liquid fuel conditioning and combustion. More particularly, the invention pertains to the dissolution of gaseous phase under pressure in the liquid phase fuel and injecting this solution into a combustion chamber. The purpose is to achieve high dispersion of the fuel in the combustion chamber of the reciprocating or gas turbine engine or any other device having a combustion chamber.

The dispersion of a liquid fuel results in highly developed active surface of the liquid fuel which allows to burn fuel more efficiently. The small size of the combustion chamber in reciprocating engines, for example, results in partial deposition of the injected fuel on the piston and combustion chamber walls and the creation of a liquid film on the walls. This part of fuel can not be burnt completely and it is lost during the exhaust cycle. Uneven distribution of the liquid fuel particles over the volume of the combustion chamber causes delay in the flame propagation lowering the effectiveness of the combustion process—delivering less power. High dispersion of the fuel would allow avoiding these problems. Completely burnt fuel results in higher efficiency and delivers more power, the temperature of its burning drops and amount of environment polluting exhaust gases (as $NO_X$ and $CO_2$) also diminishes with the drop of exhaust temperature.

There are different ways to provide dispersion of the liquid fuel, for instance with the help of fuel injectors or carburetors. The latest efforts in the area of fuel injection by the most prominent automotive engine design companies have resulted in the development of very high pressure injection systems—up to 2400 bar. On one hand, this level of pressure provides for very fine dispersion of fuel and ensures a significantly improved efficiency of the internal combustion engine but, on the other hand, this level of pressure requires more reliable and more expensive technology.

There are known attempts to disperse fuel by dissolving some gas, for instance air or $CO_2$ in the liquid fuel and subsequently injecting this solution into the combustion chamber. When injected into the combustion chamber where the pressure is lower than in the solution, the dissolved gas is released violently from the solution. This provides for very fine dispersion of the liquid fuel.

There exist several prior patents, for instance U.S. Pat. Nos. 4,596,210; 6,273,072; and 7,011,048 which describe and claim devices and methods providing for implementation and realization of the described effect. As far as is known to us, however, none of those concepts has been successfully implemented on the internal combustion engine being installed on any marketed device or on any other device having combustion chamber (e.g., a furnace).

SUMMARY OF THE INVENTION

It is accordingly an object of the invention to provide a method and an apparatus which overcomes the above-mentioned disadvantages and which provides for further improvement in the fuel/gas solution injection into a combustion chamber and for the attendant improvement in the thermodynamic efficiency of the combustion.

With the foregoing and other objects in view there is provided, in accordance with the invention, a fuel conditioning and combustion chamber fuel supply system, comprising:

a plurality of vessels, each defining a fuel chamber for fuel conditioning, at least one fuel dispersing nozzle mounted for discharge into the fuel chamber, at least one gas inlet port, a gas outlet port with a gate valve and a pressure reducer mounted thereon;

a low level sensor disposed to register a low level of conditioned fuel in a respective one of the fuel chambers;

a gas source fluidically connected with the gas inlet port for feeding a gas to the vessels wherein the gas is dissolved in the liquid fuel for forming a liquid/gas fuel solution;

a gas delivery and gas pressure control system with flow-directional valves and gas pressure regulators for supplying gas and maintaining a relatively high, first gas pressure $P_1$ and a relatively low, second gas pressure $P_2$;

a low-pressure fuel pump and a liquid fuel supply line for supplying liquid fuel from a fuel reservoir to the at least one dispersing nozzle of each the fuel chamber at a third pressure $P_3$ higher than the first pressure $P_1$;

a high-pressure fuel pump for feeding conditioned fuel to a combustion chamber at a fourth pressure $P_4$ higher than a pressure in the combustion chamber at a moment of combustion; and an electronic control system connected to receive a signal from the low level sensor and for switching the gas delivery and gas pressure control system over from the fuel chamber indicated by the sensor as depleted to supply the conditioned fuel from another, filled-up fuel chamber.

In accordance with the invention, there is also provided a high level sensor for registering a high level of conditioned fuel in each of the fuel chambers. Preferably, the first gas pressure $P_1$ is between 20% and 50% higher than the second gas pressure $P_2$. It is further preferred that the third pressure $P_3$ is higher than the second gas pressure $P_2$ to ensure a fuel pressure drop sufficient for satisfactory dispersing by the nozzle.

With the above and other objects in view there is also provided, in accordance with the invention, a method of conditioning fuel and supplying conditioned fuel to a combustion process, the method which comprises:

providing a plurality of vessels for fuel conditioning, each vessel having a housing, at least one fuel dispersing nozzle, a gas inlet port, gas outlet port and a system for releasing gas for lowering a gas pressure in the vessel to a predetermined, relatively low, first pressure $P_1$, a fuel outlet port, at least one level sensor for registering an upper level of conditioned fuel in the vessel and for registering a lower level of conditioned fuel in the vessel;

feeding liquid fuel into one of the vessels at a relatively high, second pressure $P_2$ higher than the first pressure $P_1$ and thereby setting a pressure drop at the nozzle sufficient to satisfactorily disperse the fuel and setting a volume of fuel flow through the nozzle sufficient for filling up the vessel by a time when the conditioned fuel is depleted in another fuel conditioning vessel;

feeding at least one gas into the depleted vessel through the gas inlet at high level pressure $P_1$ during the process of fuel conditioning in this vessel;

feeding the same gas into another vessel through the gas inlet at the low level pressure $P_2$ during the process of feeding conditioned fuel into the high-pressure fuel pump and further into combustion chamber of the internal combustion engine;

switching feeding automatically, upon the signal from sensor for registering lower level of conditioned fuel in the vessel, when this vessel is depleted, to the filled up one, simultaneously opening a gas outlet gate valve of filled up vessel, allowing pressure in this vessel to drop from the high pressure level $P_1$ to the low level pressure $P_2$ set up by pressure reducer mounted down stream after gate valve on the gas outlet; closing gas outlet gate valve of the depleted vessel and switching all flow-directional valves from depleted vessel to the filled up one automatically, upon a signal from conditioned fuel low level registering sensor.

There is also provided, in accordance with the invention, a fuel conditioning system for an internal combustion engine fuel delivery system, including a fuel injection system for injecting into a combustion chamber of the internal combustion engine. The fuel conditional system comprises:

a plurality of vessels for fuel conditioning, each vessel having a housing and at least one fuel dispersing nozzle mounted therein, gas inlet ports and gas outlet port with means for selectively releasing gas for lowering a gas pressure in the respective the vessel to a preliminary set up low level $P_2$;

a fuel outlet port and sensors for a fuel upper level and conditioned fuel lower level control in each vessel;

a plurality of flow-directional valves controlled by an automatic system governed by signals from the fuel level registering sensors;

a low-pressure pump for providing liquid fuel flow at a low pressure to at least one dispersing nozzle mounted in the fuel conditioning vessel, the pressure being set up at a level higher than a level of the high gas pressure in the vessel to provide for a fuel pressure drop sufficient for satisfactory dispersion of the fuel by the nozzle;

a high-pressure pump for feeding into the combustion chamber at a pressure higher than a pressure level in the combustion chamber at a moment of combustion; and a piping circuit fluidically connecting the various devices of the system.

The configuration of present invention providing significant fuel economy is quite different from those described in the aforementioned patents.

An internal combustion engine with fuel supply system having a fuel tank and a high pressure pump is provided together with plurality of the fuel conditioning vessels (two for example) installed between the fuel tank and the high pressure pump. The fuel conditioning vessels are working alternately for dissolving gas such as air or $CO_2$ in the fuel and for delivering the resulted solution to the high pressure pump. A set of nozzles dispersing pressurized fuel delivered from the fuel tank by low pressure fuel pump to the fuel conditioning vessels is provided together with the upper and lower level registering sensors for level control of conditioned fuel. Fuel conditioning vessels are also equipped with the gas inlets and the gas outlets for feeding gas in and letting it out. The gas supply source—a gas tank or a compressor (for the air) is provided with the pressure regulators for the ability to control the pressure of gas supplied to the vessels. The solenoid gate valves and the pressure relieve valves are mounted on the gas outlets of the fuel conditioning vessels to provide for the possibility of inside vessels pressure control in proper time. The fuel conditioning vessels are equipped also with fuel outlets located at the bottom of these vessels. The piping system with solenoid controlled flow-directional valves is also provided for alternate connection of the fuel conditioning vessels with fuel and gas sources and with the high pressure fuel pump.

The electronic control system (not shown) is provided for alternate operation of the fuel conditioning vessels one being the filled-up vessel and the other being the depleted vessel. The control system switches the feed line of the high pressure fuel pump from the depleted vessel to the filled-up vessel. At the same time the control system is switching a gas and fuel supply lines from the filled up fuel conditioning vessel to the depleted vessel starting to prepare new portion of the solution in the depleted vessel with gas pressure in it being set up to the level $P_1$ and dropping in the same time a gas pressure in the filled up fuel conditioning vessels to the level $P_2$.

For this purpose the control system opens the solenoid gate valve mounted on the gas outlet of this filled up solution conditioning vessel allowing pressure drop in it to the level $P_2$ which is set up at the pressure relieve valve mounted down stream after the solenoid gate valve and simultaneously the control system switches a solenoid controlled flow-directional gas valve mounted on the pressurized to the level $P_2$ gas feeding line supplying gas with the pressure $P_2$ to the filled up fuel conditioning vessel.

As a result of a consumption of the fuel by the internal combustion engine the level of fuel in the filled up fuel conditioning vessel which is feeding the high pressure fuel pump eventually drops down to the level being set up by lower level registering sensor and the control system in response to the signal from the sensor is switching all solenoid controlled flow-directional valves to the state of connecting the piping system for feeding the internal combustion engine from another fuel conditioning vessels, which is already filled up with modified fuel.

The upper level registering sensors are sending signal to the electronic control system to turn off the low pressure fuel pump when the fuel is reaching its set up upper level in the vessels.

Other features which are considered as characteristic for the invention are set forth in the appended claims.

Although the invention is illustrated and described herein as embodied in a fuel conditioning method and apparatus for improving combustion, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAIL DESCRIPTION OF THE PREFERRED EMBODIMENT

Figure 1:
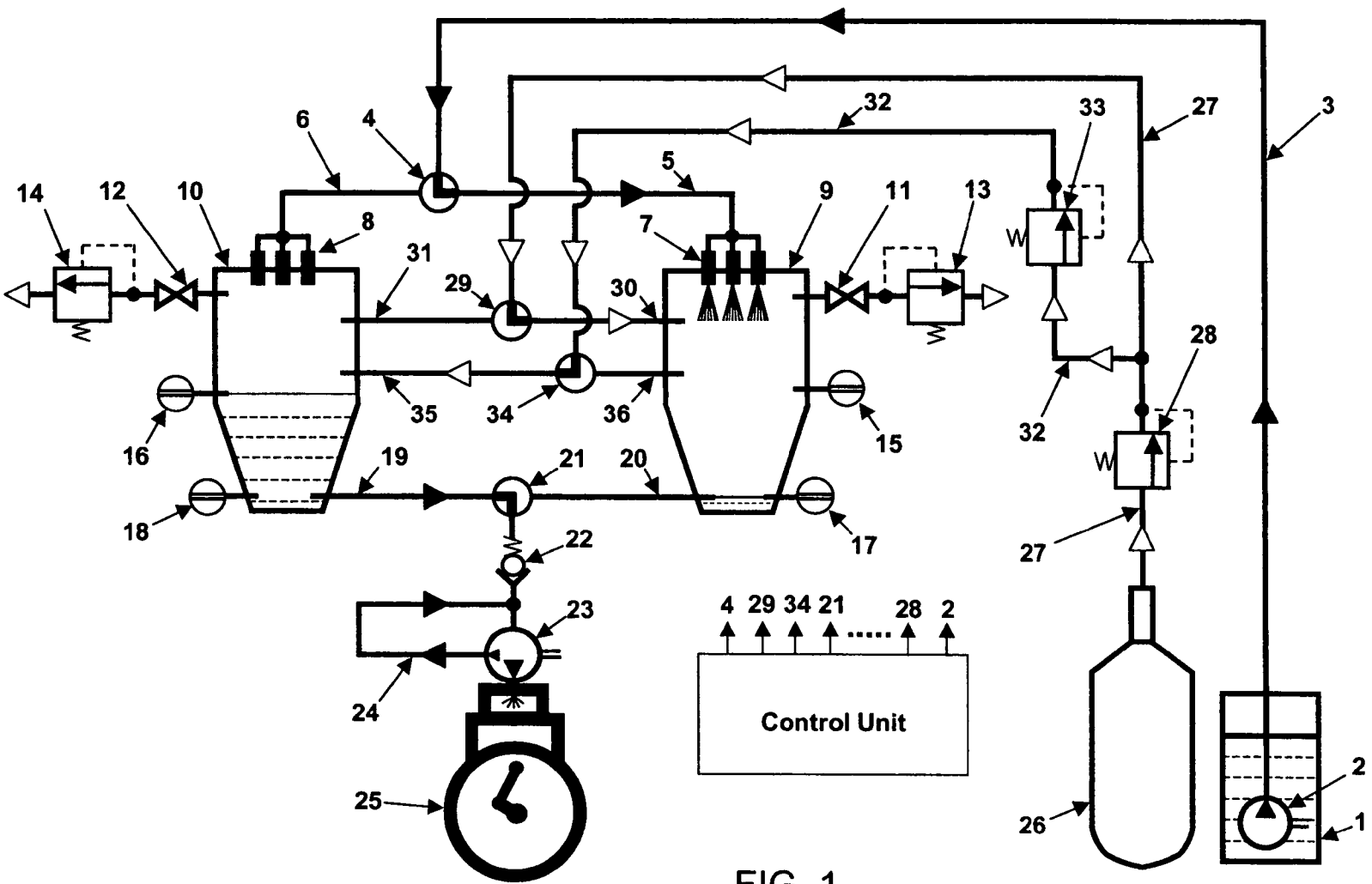
FIG. 1 is a diagrammatic view of the fuel system when the internal combustion engine is supplied from a first fuel conditioning vessel.
Figure 2:
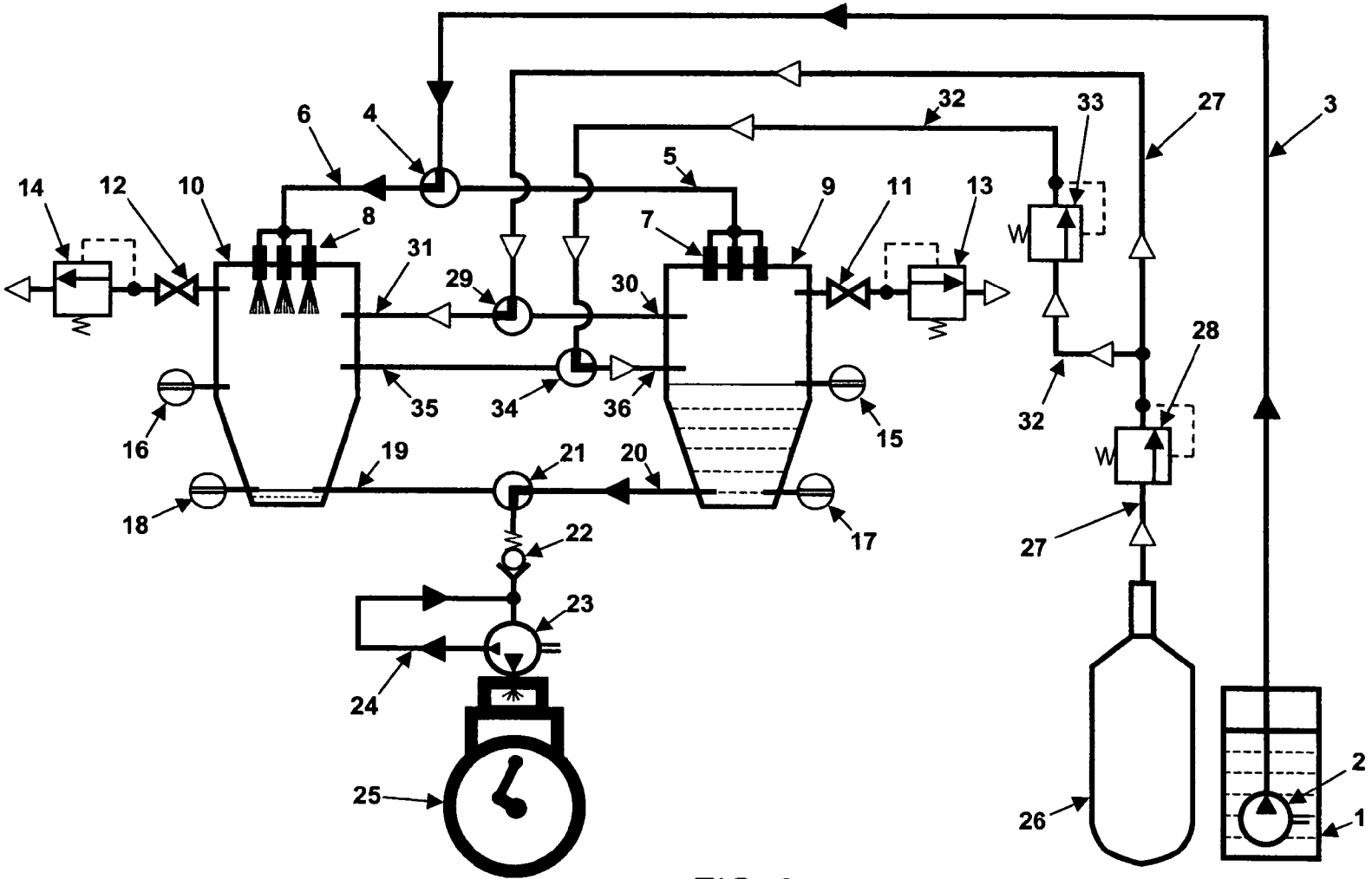
FIG. 2 is a diagrammatic view of the fuel system when the internal combustion engine is supplied from a second fuel conditioning vessel.

Referring now to the figures of the drawing in detail, the system illustrated in FIGS. 1 and 2 includes a fuel tank 1, a low-pressure fuel pump 2 for delivering liquid fuel from the fuel tank 1 through a fuel line 3 to a fuel valve 4 (e.g. a 3-port-2-finite-position solenoid valve). In FIG. 1, the valve 4 further directs the flow of the fuel through a fuel line 5 to a set of nozzles 7 mounted in a fuel conditioning vessel 9.

The fill level in the vessel 9 is sensed with at least two sensors. The upper level ("full") of fuel supplied to the fuel conditioning vessels 9 is registered by a sensor 15 and lower level ("empty") of the conditioned fuel left in the fuel conditioning vessel 9 is registered by a sensor 17.

The source of the compressed gas 26 (for instance air or $CO_2$) is connected by a line 27 to the pressure reducer 28 which controls the pressure of gas at the level $P_1$ in the line 27. The line 27 delivers gas further to the 3-port-2-finite-position solenoid gas valve 29 which directs gas through the inlet 30 to the zone above the surface of conditioned fuel in the vessels 9 sustaining the process of fuel conditioning in the vessel.

A gas line 32 is equipped with the pressure reducer 33 controlling pressure of gas at the level $P_2$ in the line 32 which branches off from the gas line 27 at the point located downstream after the pressure reducer 28.

The line 32 is provided for delivering gas to the (3-port-2-finite-position solenoid) gas valve 34 which directs gas through the inlet 35 to the zone above the surface of the conditioned fuel in the vessel 10. The latter is provided with a gas outlet that has mounted on it a gate valve 12 and a pressure relief valve 14 downstream.

An outlet 19 is provided at the bottom of the vessel 10 for delivery of the conditioned fuel to the (3-port-2-finite-position solenoid) fuel valve 21, which controls conditioned fuel delivery from the vessel 10 to the high-pressure pump 23. That is, the fuel valve 21 may be set in either of two positions in which the combustion is supplied with conditioned fuel from the vessel 9 or from the vessel 10, respectively.

A high-pressure fuel pump 23 further compresses the conditioned fuel and feeds it into the combustion chamber. Here, we illustrate a combustion chamber of an internal combustion engine (4-stroke Otto engine) 25. The overflow of the pump 23 is directed back to this pump 23 with the help of the loop line 24 while a check valve 22 prevents flow of the conditioned fuel back to the fuel conditioning vessel 10.

The volume of the fuel flowing through the set of nozzles 7 provides a filling up of the fuel conditioning vessel 9 on or before the conditioned fuel is depleted in the fuel conditioning vessel 10.

When conditioned in the vessel 10 fuel is consumed by the internal combustion engine 25 to the level being set up by the lower level registering sensor 18, the sensor sends a signal to an electronic control system and the fuel and gas feeding system is switched to the state shown on FIG. 2.

The electronic control system, which, in an internal combustion engine may be integrated in an electronic engine control unit ECU is diagrammatically illustrated only in FIG. 1 as a control unit. Further, only a few of the functional connections are illustrated. It will be understood from the description herein that many of the functional units described herein will be connected to and/or controlled by the electronic control system.

In that case the low-pressure fuel pump 2 delivers liquid fuel from the fuel tank 1 through the fuel line 3 to the 3-port-2-finite-position solenoid fuel valve 4 further to the fuel line 6 and to the set of nozzles 8 mounted in the fuel conditioning vessel 10.

The upper level of fuel supplied to the fuel conditioning vessel 10 is registered by sensor 16 and the lower level of the conditioned fuel left in the fuel conditioning vessel 10 is registered by a sensor 18.

The line 27 delivers gas to the 3-port-2-finite-position solenoid gas valve 29 which is now directing gas through the inlet 31 to the zone above the surface of conditioned fuel in the vessel 10 sustaining the process of fuel conditioning in the vessel 10.

Line 32 is provided for delivering gas (for instance air or $CO_2$) to the 3-port-2-finite-position solenoid gas valve 34 which directs gas through the inlet 36 to the zone above the surface of conditioned fuel in the vessel 9 which has the gas outlet with mounted on it gate valve 11 and downstream after gate valve 11 the pressure relieve valve 13.

The outlet 20 is provided at the bottom of the vessel 9 for delivery of the conditioned fuel further to the 3-port-2-finite-position solenoid fuel valve 21 which, in the position illustrated in FIG. 2, directs conditioned fuel from the vessel 9 to the high-pressure fuel pump 23.

The high-pressure fuel pump 23 further compresses the conditioned fuel and feeds it into the combustion chamber of the internal combustion engine 25. The overflow of the pump 23 is directed back to this pump 23 with the help of the loop line 24. The check valve 22 prevents flow of the conditioned fuel back to the vessel 9.

The volume of the fuel flowing through the set of nozzles 8 provides a filling up of the fuel conditioning vessel 10 on or before the conditioned fuel is depleted in the fuel conditioning vessel 9.

When conditioned in the vessel 9 fuel is consumed by the internal combustion engine 25 to the level defined by the lower pressure sensor 17, the sensor sends a signal to the electronic control system and the fuel and gas feeding system is switched back to the state shown on FIG. 1.

This way the process of feeding the internal combustion engine by conditioned fuel can continue as long as it is necessary. It will be understood by those of skill in the art that the implementations illustrated and described here are but exemplary. Various modifications are possible. One exemplary modification would be the number of the vessels 9 and 10. The number is not limited to two. It is also possible to provide a single vessel, possibly with a multi-chamber configuration, or several vessels which may be selected by way of the appropriate number and configuration of valves and feed lines. The expression "a plurality of vessels" encompasses these variations.

We claim:

1. A fuel conditioning and combustion chamber fuel supply system, comprising:

a plurality of vessels, each defining a fuel chamber for fuel conditioning, at least one fuel dispersing nozzle mounted for discharge into said fuel chamber, at least one gas inlet port, a gas outlet port with a gate valve and a pressure reducer mounted thereon;

a low level sensor disposed to register a low level of conditioned fuel in a respective one of said fuel chambers;

a gas source fluidically connected with said gas inlet port for feeding a gas to said vessels wherein the gas is dissolved in the liquid fuel for forming a liquid/gas fuel solution;

a gas delivery and gas pressure control system with flow-directional valves and gas pressure regulators for supplying gas and maintaining a relatively high, first gas pressure $P_1$ and a relatively low, second gas pressure $P_2$;

a low-pressure fuel pump and a liquid fuel supply line for supplying liquid fuel from a fuel reservoir to said at least one dispersing nozzle of each said fuel chamber at a third pressure $P_3$ higher than said first pressure $P_1$;

a high-pressure fuel pump for feeding conditioned fuel to a combustion chamber at a fourth pressure $P_4$ higher than a pressure in the combustion chamber at a moment of combustion; and an electronic control system connected to receive a signal from said low level sensor and for switching said gas delivery and gas pressure control system over from the fuel chamber indicated by said sensor as depleted to supply the conditioned fuel from another, filled-up fuel chamber.

2. The system according to claim 1, which comprises a high level sensor for registering a high level of conditioned fuel in each of said fuel chambers.

3. The system according to claim 1, wherein the first gas pressure $P_1$ is between 20% and 50% higher than the second gas pressure $P_2$.

4. The system according to claim 1, wherein the third pressure $P_3$ is higher than the second gas pressure $P_2$ to ensure a fuel pressure drop sufficient for satisfactory dispersing by said nozzle.

5. A method of conditioning fuel and supplying conditioned fuel to a combustion process, the method which comprises:

(a) providing a plurality of vessels for fuel conditioning, each vessel having a housing, at least one fuel dispersing nozzle, a gas inlet port, gas outlet port and a system for releasing gas for lowering a gas pressure in the vessel to a predetermined, relatively low, first pressure $P_1$, a fuel outlet port, at least one level sensor for registering an upper level of conditioned fuel in the vessel and for registering a lower level of conditioned fuel in the vessel;

(b) feeding liquid fuel into one of the vessels at a relatively high, second pressure $P_2$ higher than the first pressure $P_1$ and thereby setting a pressure drop at the nozzle sufficient to satisfactorily disperse the fuel and setting a volume of fuel flow through the nozzle sufficient for filling up the vessel by a time when the conditioned fuel is depleted in another fuel conditioning vessel;

(c) feeding at least one gas into the depleted vessel through the gas inlet at high level pressure $P_1$ during the process of fuel conditioning in this vessel;

(d) feeding the same gas into another vessel through the gas inlet at said low level pressure $P_2$ during the process of feeding conditioned fuel into the high-pressure fuel pump and further into combustion chamber of the internal combustion engine;

(e) switching feeding automatically, upon the signal from sensor for registering lower level of conditioned fuel in said vessel, when this vessel is depleted, to the filled up one, simultaneously opening a gas outlet gate valve of filled up vessel, allowing pressure in this vessel to drop from said high pressure level $P_1$ to said low level pressure $P_2$ set up by pressure reducer mounted down stream after gate valve on the gas outlet; closing gas outlet gate valve of the depleted vessel and switching all flow-directional valves from depleted vessel to the filled up one automatically, upon a signal from conditioned fuel low level registering sensor.

6. The method according to claim 5, wherein the gas high pressure is between 20% to 50% higher than the gas low pressure.

7. The method according to claim 5, wherein the fuel low pressure is higher than the gas pressure level $P_1$ to provide for a fuel pressure drop sufficient for satisfactory dispersion of the liquid fuel by said nozzle.

8. The method according to claim 5, wherein a level of the gas concentration in the solution exceeds the solution saturation level for conditions present in the combustion chamber at a moment of injection.

9. In an internal combustion engine fuel delivery system, including a fuel injection system for injecting into a combustion chamber of the internal combustion engine, a fuel conditioning system, comprising:

a plurality of vessels for fuel conditioning, each vessel having a housing and at least one fuel dispersing nozzle mounted therein, gas inlet ports and gas outlet port with means for selectively releasing gas for lowering a gas pressure in the respective said vessel to a preliminary set up low level $P_2$;

a fuel outlet port and sensors for a fuel upper level and conditioned fuel lower level control in each vessel;

a plurality of flow-directional valves controlled by an automatic system governed by signals from said fuel level registering sensors;

a low-pressure pump for providing liquid fuel flow at a low pressure to at least one dispersing nozzle mounted in said fuel conditioning vessel, the pressure being set up at a level higher than a level of the high gas pressure in said vessel to provide for a fuel pressure drop sufficient for satisfactory dispersion of said fuel by said nozzle;

a high-pressure pump for feeding conditioned fuel into the combustion chamber at a pressure higher than a pressure level in the combustion chamber at a moment of combustion; and a piping circuit fluidically connecting the various devices of the system.

* * * * *